US010378127B2

(12) United States Patent
Aydelette et al.

(10) Patent No.: US 10,378,127 B2
(45) Date of Patent: Aug. 13, 2019

(54) JADE-CONTAINING FIBER, YARN, AND MOISTURE WICKING, COOLING FABRIC

(71) Applicant: VF JEANSWEAR, L.P., Greensboro, NC (US)

(72) Inventors: Phillip F. Aydelette, Greensboro, NC (US); Edward J. Broyles, Jr., Greensboro, NC (US); E. Ashley Harris, Greensboro, NC (US); Leigh Jillion Humphrey, Charlotte, NC (US); Carole C. McFee, Greensboro, NC (US); Jason C. Napier, Greensboro, NC (US); John T. Strickland, Greensboro, NC (US)

(73) Assignee: VF Jeanswear, L.P., Greensboro, NC (US)

( * ) Notice: Subject to any disclaimer, the term of this patent is extended or adjusted under 35 U.S.C. 154(b) by 0 days.

(21) Appl. No.: 15/325,319

(22) PCT Filed: Jul. 10, 2015

(86) PCT No.: PCT/US2015/039898
§ 371 (c)(1),
(2) Date: Jan. 10, 2017

(87) PCT Pub. No.: WO2016/007830
PCT Pub. Date: Jan. 14, 2016

(65) Prior Publication Data
US 2017/0198417 A1 Jul. 13, 2017

Related U.S. Application Data

(60) Provisional application No. 62/023,647, filed on Jul. 11, 2014.

(51) Int. Cl.

| | |
|---|---|
| ***D02G 3/04*** | (2006.01) |
| ***D01D 5/42*** | (2006.01) |
| ***D01F 1/10*** | (2006.01) |
| ***D01F 6/62*** | (2006.01) |

(52) U.S. Cl.
CPC ..... *D02G 3/04* (2013.01); *D01D 5/426* (2013.01); *D01F 1/10* (2013.01); *D01F 6/62* (2013.01); *D10B 2331/04* (2013.01); *D10B 2401/02* (2013.01); *D10B 2501/00* (2013.01)

(58) Field of Classification Search
CPC .... D01F 1/10; D01F 6/62; D02G 3/04; D10B 2331/04; D10B 2401/02; D01D 5/426; D01D 5/08; D03D 13/00; D03D 15/00; D06M 11/79
See application file for complete search history.

(56) References Cited

U.S. PATENT DOCUMENTS

| | | | | |
|---|---|---|---|---|
| 2004/0058072 | A1 | 3/2004 | Rearick et al. | |
| 2015/0106992 | A1* | 4/2015 | Blakely | A41D 31/02 2/69 |
| 2017/0044695 | A1* | 2/2017 | Hays | D02J 1/00 |
| 2017/0145596 | A1* | 5/2017 | Hays | B32B 5/026 |

FOREIGN PATENT DOCUMENTS

| | | | |
|---|---|---|---|
| CN | 202936579 U | * | 5/2013 |
| CN | 103194830 A | | 7/2013 |
| CN | 203174261 U | | 9/2013 |
| JP | H9-310225 | | 12/1997 |
| KR | 20000018232 A | * | 4/2000 |

OTHER PUBLICATIONS

International Search Report and Written Opinion corresponding to International Patent Application No. PCT/US2015/39898, dated Dec. 10, 2015.

* cited by examiner

*Primary Examiner* — Arti Singh-Pandey
(74) *Attorney, Agent, or Firm* — Smith, Gambrell & Russell LLP

(57) ABSTRACT

The present disclosure describes a yarn comprising a blend of jade-containing fibers, such as jade-containing polyester fibers, with hydrophobic cotton fibers and optionally conventional fibers. The jade in the jade-containing polyester fibers provides the yarn with a cooling effect when it contacts a person's skin. The hydrophobic cotton fibers provide the yarn with hydrophobicity. When included in a fabric that also contains yarn having hydrophilic properties in a manner such that a higher percentage of the hydrophobic yarn is present on the back surface of the fabric than on the front surface of the fabric, the fabric has a cooling and moisture-wicking effect. The yarn may be used as the fill of a denim twill weave to provide denim clothing having enhanced cooling and moisture-wicking properties.

22 Claims, 1 Drawing Sheet

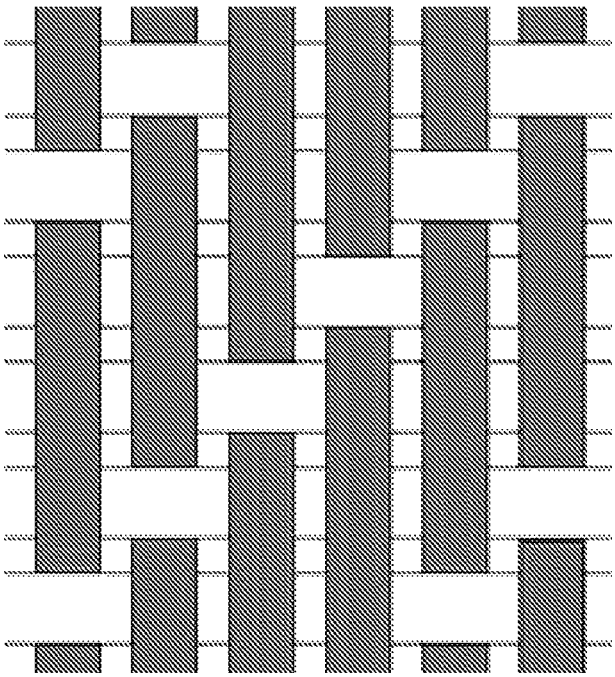

JADE-CONTAINING FIBER, YARN, AND MOISTURE WICKING, COOLING FABRIC

BACKGROUND OF THE INVENTION

The present invention relates to fabrics having cooling and moisture-wicking effects. In some embodiments, for example, the present invention relates to yarn that is configured to provide a fabric having cooling and moisture-wicking effects, the yarn comprising a blend of a jade-containing synthetic fiber and a cotton fiber that is treated to provide hydrophobicity. The yarn may be used, for example, in the fill yarns of a fabric, which may be largely exposed on the back of the fabric, which contacts a person's skin. In some embodiments, the yarn is used in the fill yarns of a denim fabric, such as may be used to manufacture denim pants, i.e. jeans, or other articles of clothing.

Denim jeans are a staple article of clothing both for work wear and casual wear. Denim jeans, however, suffer from the drawback that they are typically uncomfortable for a wearer in warmer temperatures. It has been found that the yarn of the present invention may be used to prepare a denim fabric that provides for improved comfort in warm temperatures by providing enhanced air permeability, moisture-wicking, and cooling effects.

SUMMARY OF THE INVENTION

One aspect of the present invention is a jade-containing thermoplastic fiber. The jade-containing thermoplastic fiber comprises a jade powder in a thermoplastic polymer matrix. In some embodiments, the fiber is a jade-containing polyester fiber. Preferably the jade powder is substantially uniformly distributed throughout the fiber. The jade powder is preferably present in the fiber in an amount sufficient to provide the fiber with a cooling effect. However, the jade powder is also preferably present in the fiber in an amount that does not interfere with the ability of the thermoplastic to form a stable and useful fiber.

Another aspect of the present invention is a method for making a jade-containing thermoplastic fiber, such as a jade-containing polyester fiber. The jade-containing thermoplastic fiber is prepared by mixing a jade powder into a thermoplastic melt and extruding the jade-containing thermoplastic melt to produce a filament. The jade-containing thermoplastic filament is then divided, or cut, to produce a number of jade-containing thermoplastic fibers. In some embodiments, the jade-containing thermoplastic filament is divided to produce staple fibers of jade-containing thermoplastic. The jade powder is mixed into the thermoplastic melt in an amount that sufficient to provide the extruded jade-containing thermoplastic filament, and the jade-containing thermoplastic fibers, with a cooling effect.

Another aspect of the present invention is a yarn comprising a blend of jade-containing fibers, such as jade-containing polyester fibers, with hydrophobic cotton fibers and/or conventional fibers. The jade in the jade-containing polyester fibers provides the yarn with a cooling effect when it contacts a person's skin. The hydrophobic cotton fibers provide the yarn with hydrophobicity. Accordingly, when included in a fabric that also contains yarn having hydrophilic properties such as conventional cotton yarn, in a manner such that a higher percentage of the hydrophobic yarn is present on the back surface of the fabric, i.e. the surface of the fabric that is configured to contact the a person's skin, than on the front surface of the fabric, the yarn provides a moisture-wicking effect. The conventional fibers may comprise cotton, polyester, or a mixture thereof, and are included in order to provide comfort, e.g. softness, and/or strength to the yarn. The type and amount of conventional fibers can be tailored depending on the fabric being prepared.

Another aspect of the present invention is a method for making a yarn comprising a blend of jade-containing fibers, such as jade-containing polyester fibers, with hydrophobic cotton fibers and/or conventional fibers. The jade-containing polyester fibers may be prepared by mixing a jade powder into a polyester melt, extruding the jade-containing polyester melt to produce a filament, and chopping the filament to produce jade-containing polyester staple fibers. The conventional fibers and hydrophobic cotton fibers are also provided in the form of staple fibers. The staple fibers are then blended, such as in an intimate blend, to produce a substantially uniform yarn.

Another aspect of the present invention is a fabric that is configured to provide both moisture-wicking and cooling benefits. The fabric may comprise warp yarns and fill yarns. The warp yarns, the fill yarns, or both may include a yarn that comprises a blend of jade-containing fibers, such as jade-containing polyester fibers, with hydrophobic cotton fibers, and optionally conventional fibers. The use of this yarn on either the warp yarns or the fill yarns is determined by the use of the fabric, with the yarn preferably being used for the portion of the weave that is designed to have the greater contact with the skin. Typically, the fill yarns include the yarn that comprises a blend of jade-containing fibers, hydrophobic cotton fibers, and conventional fibers. The warp yarns may comprise any conventional yarn and in some embodiments is conventional cotton yarn. Some embodiments of the fabric comprise a denim twill weave in which the fill yarns comprise a blend of at least jade-containing fibers and hydrophobic cotton fibers and the warp yarns are conventional cotton yarn, such as an indigo-dyed cotton yarn.

Another aspect of the present invention is clothing that comprises a fabric, the fabric being prepared using a yarn that comprises a blend of jade-containing fibers, such as jade-containing polyester fibers, with hydrophobic cotton fibers and/or conventional fibers. The clothing is configured such that the yarn is predominantly on the back of the fabric, i.e. the surface of the clothing that is in contact with the skin of a wearer. For example, the yarn may be used as the fill yarns, with a conventional yarn being used as the warp yarns. In some embodiments, the clothing comprises denim pants, e.g. jeans. In other embodiments, the clothing may comprise shirts, jackets, and the like.

DETAILED DESCRIPTION OF THE INVENTION

Jade-Containing Fibers

Embodiments of the present invention are directed toward one or more fibers, the fiber comprising a thermoplastic polymer and a jade powder distributed throughout the thermoplastic polymer.

The thermoplastic polymer may be any thermoplastic polymer that is configured for use in a fabric, such as a wearable fabric. In some embodiments, the thermoplastic polymer may comprise polypropylene, polyester, nylon, polybenzimidazole, polyacrylonitrile (acrylics), polyurethane elastomers such as spandex, plant-based polymers such as corn-based polymers, and mixtures thereof. More particularly, in some embodiments the thermoplastic polymer may comprise polyester, nylon, polypropylene, and mixtures thereof. More particularly, the thermoplastic polymer may be polyester.

The jade is preferably crushed to form a powder. In some embodiments, the jade powder may also comprise other crushed minerals in addition to jade. Preferably, however, the jade powder comprises at least about 50% jade, alternatively at least about 60%, alternatively at least about 70%, alternatively at least about 80%, alternatively at least about 90% jade.

The jade powder is blended with the melt, i.e. the molten thermoplastic polymer, prior to extrusion. In some embodiments the jade powder may be mixed with the molten thermoplastic polymer just prior to or during extrusion. The mixture of molten thermoplastic polymer and jade powder is then extruded to produce a filament through a conventional method, which would be understood by persons of ordinary skill in the art. By mixing the jade powder with the melt and extruding the mixture, one may produce a jade-containing thermoplastic filament. The jade is substantially evenly distributed throughout the filament.

In some embodiments, the jade-containing thermoplastic polymer filament is then cut to produce a jade-containing thermoplastic polymer fiber, referred to herein simply as a jade-containing fiber. In some embodiments, the jade-containing fiber is a staple fiber. Staple fibers typically are fibers that are cut, such as from a filament, to a substantially uniform length that falls within the range between about 0.75 inches and about 4 inches. In some embodiments, the jade-containing fibers may have a length between about 0.75 inch and about 2.5 inches. Preferably, the jade-containing thermoplastic fibers have a substantially uniform length. For example, in some embodiments, the jade-containing fibers may have a length of about 1 inch, alternatively the jade-containing fibers may have a length of about 1.5 inches, alternatively the jade-containing fibers may have a length of about 2 inches. In other embodiments, the jade-containing thermoplastic polymer filament is not cut, but is spun (e.g. continuously) with other fibers or filaments to create a jade-containing yarn.

The jade-containing thermoplastic polymer filament and the jade-containing fibers that are produced by cutting, chopping or the like, may be configured to have a variety of cross-sectional shapes. In some embodiments, the jade-containing fibers may have a cross-section that comprises channels, such as an X-shaped cross-section or a Y-shaped cross-section. However, while the incorporation of channels into the cross-section of a fiber may provide an enhancement in the transport of moisture away from the skin (such as through a capillary effect), no particular cross-sectional shape is necessary for the jade-containing fibers to be useful to provide the effects disclosed, herein. Rather, the jade-containing fibers may have a cross-section that does not contain channels, such as a substantially round cross-section, a substantially rectangular cross-section, or convex polygonal cross-section. Jade-containing fibers having a cross-section without channels have been found effective in the jade-containing yarn and moisture-wicking, cooling fabrics described herein.

The amount of jade powder added to the thermoplastic polymer may be selected so as to provide the jade-containing fibers with a property of being cool to the touch. One must also be careful, however, that the amount of jade powder added to the thermoplastic polymer does not cause undue degradation of the fiber. As the content of jade powder in the mixture increases, the strength of the jade-containing thermoplastic polymer filament and fibers decreases due to interruption of the polymer chains by the jade powder. Once the amount of jade powder exceeds a certain threshold, it may be impossible to form the thermoplastic polymer filament altogether.

The amount of jade powder in the thermoplastic polymer may be selected to provide fibers having a desired balance of properties, as could be determined by a person of ordinary skill in the art. In some embodiments, and especially where polyester is used as the thermoplastic polymer, the jade powder may provide between about 0.3 percent by weight and about 1.5 percent by weight of the fibers, alternatively between about 0.5 percent by weight and about 1.3 percent by weight, alternatively between about 0.75 percent by weight and about 1.25 percent by weight, alternatively between about 0.9 percent by weight and about 1.1 percent by weight.

Jade-Containing Yarn

Jade-containing fibers, such as those described above, may be blended with other fibers in order to prepare a yarn.

For instance, the jade-containing fibers may be blended with a hydrophobic cotton fiber. A hydrophobic cotton fiber is a cotton fiber that has been treated so as to provide the cotton with a hydrophobic character (as opposed to natural cotton, which is hydrophilic). The hydrophobic cotton fiber may be treated by any conventional methods known in the art. For example, hydrophobic treatments may include application of a material such as, for example, silicones, fluorochemicals, zirconium compounds, oils, latexes, waxes, crosslinking resins such as dimethylol dihydroxy ethylene urea (DMDHEU), urea formaldehyde, ethylene urea, melamine resins, dimethyl urea glyoxal (DMUG), carboxylic acids and polycarboxylic acids including citric, maleic, butane tetra carboxylic, polymaleic acids, and mixtures thereof. In some embodiments, the hydrophobic treatment comprises application of one or more fluorochemicals, such as a C6 fluorocarbon based water repellent or a C8 fluorocarbon based water repellent of the type that are typically used in the industry. When the yarn is to be used for clothing, the hydrophobic treatment should be durable enough to withstand repeated home launderings.

In some embodiments, the hydrophobic cotton fibers are provided in their naturally grown fiber lengths, such as may fall within the range between about 0.75 inches and about 4 inches. Preferably the hydrophobic cotton fibers have substantially the same length as the jade-containing fibers. This allows for a more uniform blending of the fibers during the yarn-making process. Accordingly, in some embodiments, the hydrophobic cotton fibers may have a length between about 0.75 inch and about 2.5 inches. Preferably, the hydrophobic cotton fibers have a substantially uniform length. For example, in some embodiments, the hydrophobic cotton fibers may have a length of about 1 inch, alternatively the hydrophobic cotton fibers may have a length of about 1.5 inches, and alternatively the hydrophobic cotton fibers may have a length of about 2 inches.

The jade-containing fiber may also be blended with one or more conventional fibers, such as natural fibers, cellulosic fibers, and synthetic fibers of the sort that are generally known for use in yarns and, more particularly, in yarns that are woven into fabrics for clothing. For example, the conventional fibers may comprise cotton, flax, silk, wool, ramie, polyester, nylon, rayon, spandex, plant-based fibers such as corn-based fibers, hemp, jute, polypropylene, polybenzimidazole, acetate, acrylics, and the like. The conventional fibers may also comprise mixtures or blends of multiple conventional fibers, including, for example, any of the above. In some embodiments, the conventional fibers comprise cotton, polyester, or combinations thereof.

In some embodiments, it may be desirable to provide one or more conventional fibers that are configured to improve the strength of the resulting yarn. As discussed above, the addition of jade powder to the thermoplastic polymer may result in a weakening of the jade-containing polymeric fiber. High-strength fibers may be used to counterbalance the weakness of the jade-containing polymeric fibers in order to produce a yarn having a desired strength. In some embodiments, for example, the conventional fibers may comprise high tenacity polyester, high tenacity nylon, high tenacity polypropylene, high tenacity rayon, and the like. In some embodiments, the conventional fibers comprise high tenacity polyester.

In some embodiments, it may also be desirable to provide one or more conventional fibers that are configured to improve the softness and comfort level of the resulting yarn. Typically natural and cellulosic fibers are viewed as providing an increased comfort relative to synthetic fibers. In some embodiments, for example, the conventional fibers may comprise cotton, wool, or mixtures thereof. In some embodiments, the conventional fibers comprise cotton.

In order to provide both strength and comfort, it may also be desirable in some embodiments to include a mixture or blend of high-tenacity synthetic fibers and high-comfort natural fibers.

In some embodiments, the conventional fibers are provided as staple fibers. Staple fibers typically are fibers that are cut to a substantially uniform length that falls within the range between about 0.75 inches and about 4 inches. Preferably the staple conventional fibers have substantially the same length as the jade-containing fibers. This allows for a more uniform blending of the fibers during the yarn-making process. Accordingly, in some embodiments, the conventional fibers may have a length between about 0.75 inch and about 2.5 inches. Preferably, the conventional fibers have a substantially uniform length. For example, in some embodiments, the conventional fibers may have a length of about 1 inch, alternatively the conventional fibers may have a length of about 1.5 inches, alternatively the conventional fibers may have a length of about 2 inches.

The jade-containing fibers may be blended with the hydrophobic cotton fibers and/or the conventional fibers to create a yarn by any conventional yarn-making process, such as those that would be known by a person of ordinary skill in the art. In some embodiments, jade-containing staple fibers may be blended with hydrophobic cotton staple fibers and/or conventional staple fibers in an intimate blend. An intimate blend incorporates the properties of the individual fiber types into a resulting yarn. Intimate blending provides that the undesirable qualities of each type of fiber may be balanced by the other type or types of fiber, so that the undesirable qualities of any one component are not a characteristic of the resulting yarn. The intimate blend may also provide that the yarn has a substantially uniform distribution of the fibers throughout the yarn, i.e. that the proportion of each type of fiber in the yarn (and hence the ratio between the types of fiber) is substantially consistent for each segment along the length of the yarn.

The proportion of each type of fiber in the yarn may be selected to provide a yarn having a desired set of properties. For instance, the proportion of the jade-containing fiber in the yarn may be selected to provide the yarn with a cooling property, in which the yarn is cool to the touch. In some embodiments, the jade-containing fiber is present in an amount between about 10 percent by weight and about 90 percent by weight of the yarn, alternatively the jade-containing fiber is present in an amount between about 20 percent by weight and about 80 percent by weight of the yarn, alternatively the jade-containing fiber is present in an amount between about 20 percent by weight and about 70 percent by weight of the yarn, alternatively the jade-containing fiber is present in an amount between about 20 percent by weight and about 60 percent by weight of the yarn, alternatively the jade-containing fiber is present in an amount between about 20 percent by weight and about 50 percent by weight of the yarn.

In some embodiments, the jade-containing fiber is blended with both a hydrophobic cotton fiber and one or more conventional fibers. In such an embodiment, it may be desirable to provide the jade-containing fiber in an amount between about 20 percent by weight and about 50 percent by weight of the yarn, alternatively between about 20 percent by weight and about 40 percent by weight of the yarn, and alternatively between about 30 percent by weight and about 40 percent by weight of the yarn. In some embodiments, the jade-containing fiber comprises at least about 33 percent by weight of the yarn. And in some embodiments, the jade-containing fiber comprises about 33 percent by weight of the yarn.

The proportion of the hydrophobic cotton fiber in the yarn may be selected to provide the yarn with a water-resistant property, which may be useful in the manufacture of moisture wicking fabrics. In some embodiments, the hydrophobic cotton fiber is present in an amount between about 10 percent by weight and about 90 percent by weight of the yarn, alternatively the hydrophobic cotton fiber is present in an amount between about 20 percent by weight and about 80 percent by weight of the yarn, alternatively the hydrophobic cotton fiber is present in an amount between about 20 percent by weight and about 70 percent by weight of the yarn, alternatively the hydrophobic cotton fiber is present in an amount between about 20 percent by weight and about 60 percent by weight of the yarn, alternatively the hydrophobic cotton fiber is present in an amount between about 20 percent by weight and about 50 percent by weight of the yarn.

In some embodiments, the jade-containing fiber is blended with both a hydrophobic cotton fiber and one or more conventional fibers. In such an embodiment, it may be desirable to provide the hydrophobic cotton fiber in an amount between about 20 percent by weight and about 50 percent by weight of the yarn, alternatively between about 20 percent by weight and about 40 percent by weight of the yarn, and alternatively between about 30 percent by weight and about 40 percent by weight of the yarn. In some embodiments, the hydrophobic cotton fiber comprises at least about 33 percent by weight of the yarn. And in some embodiments, the hydrophobic cotton fiber comprises about 33 percent by weight of the yarn.

The proportion of the conventional fiber or fibers in the yarn may be selected to provide the yarn with any of a number of desired property or properties, such as improved strength and/or improved softness/comfort. In some embodiments, the conventional fiber (which for purposes of the determining the percentage of the yarn should be considered to include all conventional fibers used in the yarn) is present in an amount between about 10 percent by weight and about 90 percent by weight of the yarn, alternatively the conventional fiber is present in an amount between about 20 percent by weight and about 80 percent by weight of the yarn, alternatively the conventional fiber is present in an amount between about 20 percent by weight and about 70 percent by weight of the yarn, alternatively the conventional fiber is present in an amount between about 20 percent by weight and about 60 percent by weight of the yarn, alternatively the conventional fiber is present in an amount between about 20 percent by weight and about 50 percent by weight of the yarn.

In some embodiments, the jade-containing fiber is blended with both a hydrophobic cotton fiber and one or more conventional fibers. In such an embodiment, it may be desirable to provide the conventional fiber (which, again, for purposes of the following percentages, should be considered to include all conventional fibers used in the yarn) in an amount between about 20 percent by weight and about 50 percent by weight of the yarn, alternatively between about 20 percent by weight and about 40 percent by weight of the yarn, and alternatively between about 30 percent by weight and about 40 percent by weight of the yarn. In some embodiments, the conventional fiber comprises at least about 33 percent by weight of the yarn. And in some embodiments, the conventional fiber comprises about 33 percent by weight of the yarn.

In some embodiments, the intimate blend is prepared by introducing the desired proportions of each fiber into the "opening" step of the yarn-making process. The opening step of the yarn-making process typically involves a process that is configured to open up or separate the clumps of fibers for processing, typically through a combination of air and mechanical actions. The yarn-making process generally continues with the "carding" step, in which the fibers are rendered substantially parallel, forming a ropelike strand. This ropelike strand is then usually subjected to a desired amount of drawing and/or twisting to provide a yarn filament having a desired degree of tightness. The final step in the process is the "spinning" step, which spins the yarn filaments together to form the yarn. The spinning may occur by any known method, including, for example, open-end spinning, ring spinning, or air jet spinning.

In some embodiments, the yarn may comprise a yarn count between about 4.0/1 Ne and about 80.0/1 Ne, where Ne is known in the industry as English cotton count. Where the yarn is used to prepare a denim fabric, for example, the yarn may comprise a yarn count between about 4.0/1 Ne and about 30.0/1 Ne, alternatively between about 5.0/1 Ne and about 25.0/1 Ne, alternatively between about 6.0/1 Ne and about 22.0/1 Ne, alternatively between about 6.0/1 Ne and about 20.0/1 Ne, alternatively between about 7.0/1 Ne and about 15.0/1 Ne. The yarn count generally measures the thickness of the yarn, with increasing numbers generally indicating an increased fineness, i.e. decreased thickness, to the yarn.

In some embodiments, the yarn comprises about 33% jade-containing fiber, such as a jade-containing polyester fiber, about 33% hydrophobic cotton, and about 33% conventional high tenacity polyester fiber. In some embodiments, the yarn comprises about 33% jade-containing fiber, such as a jade-containing polyester fiber, about 33% hydrophobic cotton, and about 33% conventional cotton fiber.

Alternatively, jade-containing thermoplastic polymer filaments may be produced, e.g. continuously, and the filaments may be spun, such as by a conventional yarn-making process, with other filaments to create a jade-containing yarn. In this way, a variety of jade-containing yarns may be prepared. For example, in some embodiments, one or more jade-containing thermoplastic polymer filaments may be spun with one or more filaments that contain hydrophobic cotton. The jade-containing thermoplastic polymer filaments may also be spun with one or more conventional filaments (see, for example, the listing of conventional fibers above) in order to obtain a jade-containing yarn having a desired set of properties. The proportion of jade-containing thermoplastic polymer filaments to be included in the yarn may be selected to produce a yarn having desired properties. In other embodiments, a number of jade-containing thermoplastic polymer filaments may be spun together to produce a jade-containing yarn that is made up wholly of jade-containing thermoplastic polymer filaments.

Fabric/Clothing

Yarns comprising jade-containing fibers, such as those described above, may be incorporated into a variety of fabrics that may be used in, for example, the manufacture of clothing. Yarns, including the yarn described above, may be woven to produce a fabric in a conventional manner, such as those that would be understood by a person of ordinary skill in the art. For example, the yarns may be woven using a plain weave (such as a 1 by 1 plain weave), a rib weave, a mat weave, a twill weave, a satin weave, an oxford weave, and the like. Alternatively, the yarns comprising jade-containing fibers may be used to prepare non-woven fabrics and/or knit fabrics.

In some embodiments, the fabric comprises fill yarns and warp yarns. The yarn incorporating the jade-containing fibers may be used in the fill yarns, the warp yarns, or both. In some embodiments, the yarn incorporating the jade-containing fibers may be used in only the fill yarns or the warp yarns, but not both. The one of the warp yarns and the fill yarns that does not comprise the yarn incorporating the jade-containing fibers preferably comprises a conventional yarn, such as a conventional cotton yarn. For example, in some embodiments, the yarn incorporating the jade-containing fibers is used only in the fill yarns and the warp yarns are conventional cotton yarn.

In some embodiments, the yarn comprising jade-containing fibers is used as the fill yarn in a denim twill weave to produce a denim fabric. The warp yarn may comprise conventional cotton yarn. The warp yarn may also include other materials, such as cellulose fibers, which are variously known in the art to be useful to increase softness, provide stretch, etc., without departing from the scope of the present disclosure.

A denim twill typically comprises a 3 by 1 twill weave, in which each warp yarn spans over three fill yarns. A standard 3 by 1 denim twill is illustrated, for example, in FIG. 1. In some embodiments, however, a denim twill may also comprise a 2 by 1 twill, in which each warp yarn spans over two fill yarns. The 2 by 1 twill is sometimes used, for example, to produce a light-weight denim. In other embodiments, a denim twill may also comprise a 4 by 1 twill, in which each warp yarn spans over four fill yarns. For purposes of description, the denim twill will hereinafter be described using the 3 by 1 twill embodiment, although a person of ordinary skill in the art would understand that other types of denim twill may be used without departing from the scope of the invention.

Because the warp yarns in a denim twill float over three fill yarns, the warp yarns are predominantly exposed on a single face, or surface, of the fabric. In a denim fabric, this is the exterior or front of the fabric. The fill yarns, on the other hand, are predominantly exposed on the opposite face, or surface, of the fabric. Accordingly, in a denim fabric, the fill yarn is predominantly exposed on the interior or back surface of the fabric. In a standard denim 3 by 1 twill, for example, about 75% of the warp yarn is exposed on the front surface of the fabric (with the other 25% being exposed on the back surface of the fabric) and about 75% of the fill yarn is exposed on the back surface of the fabric (with the other 25% being exposed on the front surface of the fabric).

In some embodiments, the yarn comprising the jade-containing fibers has a predominantly hydrophobic character. The jade-containing fibers may be produced from synthetic polymers that are generally hydrophobic in character. For example, the jade-containing fibers may be jade-containing polyester fibers, which are hydrophobic. And the hydrophobic cotton fibers have been treated so as to be hydrophobic. In some embodiments, the yarn may also comprise conventional fibers, which may be either hydrophilic cotton fibers, hydrophobic synthetic fibers, or a blend thereof. In some embodiments, the conventional fibers may be high-tenacity polyester fibers, which are hydrophobic. In general, the yarn comprising the jade-containing fibers may be configured to have a predominantly hydrophobic character.

In a denim fabric, for example, the yarn comprising the jade-containing fibers is preferably used as the fill yarn (either as part of the fill yarns or as the entirety of the fill yarns). On the other hand, the warp yarn, which for example may be a conventional cotton yarn, preferably has a predominantly hydrophilic character.

Because the fill yarn, which is largely exposed on the back surface of the fabric, i.e. the surface that is configured to contact the skin of a wearer, is predominantly hydrophobic, it does not readily absorb sweat from the skin of a wearer. The hydrophilic warp yarn, on the other hand, readily absorbs sweat from the skin of a wearer. Because the warp yarn is largely exposed to the front surface of the fabric, the sweat absorbed by the portion of the hydrophilic warp yarn that contacts the skin of a wearer (i.e. the portion that is exposed on the back surface of the fabric) is transferred to the front surface of the fabric. In this way, the fabric is configured to wick moisture away from the skin of a user to the outer face of a fabric, where it is spread out across the outer face of the fabric for drying, such as may occur naturally.

Accordingly, in many embodiments it may be desirable to configure the fabric so that the yarn comprising the jade-containing fiber is predominantly exposed on the back surface of the fabric, i.e. the surface of the fabric that is configured to contact a person's skin, in order to provide the fabric with a moisture-wicking character. It is also desirable that the yarn comprising the jade-containing fiber is predominantly exposed on the back surface of the fabric because the jade provides the yarn, and hence the fabric, with the characteristic that it is cool to the touch—a property that is useful where the fabric contacts a wearer's skin.

For example, in some embodiments, greater than 50% of the yarn comprising the jade-containing fiber is exposed on the back surface of the fabric, i.e. the surface of the fabric that is configured to contact a person's skin. Alternatively at least 60% of the yarn comprising the jade-containing fiber is exposed on the back surface of the fabric, alternatively at least 65% of the yarn comprising the jade-containing fiber is exposed on the back surface of the fabric, alternatively at least 70% of the yarn comprising the jade-containing fiber is exposed on the back surface of the fabric, alternatively at least 75% of the yarn comprising the jade-containing fiber is exposed on the back surface of the fabric, alternatively at least 80% of the yarn comprising the jade-containing fiber is exposed on the back surface of the fabric.

In some embodiments, where the yarn comprising jade-containing fibers is used in the fill yarns, the fabric may be woven such that greater than 50% of the fill yarns are exposed on the back surface of the fabric. Alternatively, the fabric may be woven such that at least 60% of the fill yarns are exposed on the back surface of the fabric, alternatively at least 65% of the fill yarns are exposed on the back surface of the fabric, and alternatively at least 70% of the fill yarns are exposed on the back surface of the fabric.

In other embodiments, the fabric may be configured so that it is the warp yarn, as opposed to the fill yarn, that is predominantly exposed on the back surface of the fabric. In those embodiments, the yarn comprising jade-containing fibers may be used in the warp yarns of the fabric (either as part of the warp yarns or as the entirety of the warp yarns). Accordingly, the fabric may be woven such that greater than 50% of the warp yarns are exposed on the back surface of the fabric. Alternatively, the fabric may be woven such that at least 60% of the warp yarns are exposed on the back surface of the fabric, alternatively at least 65% of the warp yarns are exposed on the back surface of the fabric, and alternatively at least 70% of the warp yarns are exposed on the back surface of the fabric.

In alternative embodiments, a jade-containing yarn that is produced by the spinning of a jade-containing thermoplastic polymer filament with other jade-containing thermoplastic polymer filaments, hydrophobic cotton-containing filaments, conventional filaments, or combinations thereof, may be incorporated into a variety of fabrics as described herein. As with the yarns comprising jade-containing fibers described above, jade-containing yarn made in this way may be incorporated into the warp and/or fill yarns, but is desirably used as one or more of the fill yarns to produce, for example, a denim fabric having improved properties.

In some embodiments, for example, a fabric may be produced that comprises each of a jade-containing yarn, such as a yarn that is predominantly or wholly spun using jade-containing thermoplastic polymer filaments, and a hydrophobic cotton-containing yarn, such as a yarn that is predominantly or wholly spun using hydrophobic cotton, in the fill. Accordingly, the fill yarn, as generally described herein, may constitute a combination of jade-containing yarn and hydrophobic cotton-containing yarn. This can be achieved, for example, through the use of alternating tics. In some embodiments, each yarn may comprise about 50% (e.g. between about 45% and about 55%) of the fill yarn, with the fill being comprised of alternating tics (1:1 ratio) of jade-containing yarn and hydrophobic cotton-containing yarn. In other embodiments, the fill may comprise more or less of either yarn. For example, if a higher jade density is desired, multiple tics of jade-containing yarn may be used for each tic of hydrophobic cotton-containing yarn (e.g. 2:1, 3:1, 4:1, etc.). Alternatively, if a higher density of hydrophobic cotton is desired, multiple tics of hydrophobic cotton-containing yarn may be used for each tic of jade-containing yarn (e.g. 2:1, 3:1, 4:1, etc.). In some embodiments, the jade-containing yarn and hydrophobic cotton-containing yarn may also be alternated with tics of conventional yarn. In some embodiments where the fill yarn constitutes a combination (e.g. alternating tics) of jade-containing yarn (e.g. yarn that is predominantly or wholly spun using jade-containing thermoplastic polymer filaments) and hydrophobic cotton-containing yarn (e.g. yarn that is predominantly or wholly spun using hydrophobic cotton), the warp yarn may be a conventional cotton yarn as has been generally described above. In other embodiments, the warp yarn may comprise other materials as has been generally described above.

In some embodiments, the fabric may also be configured to provide for enhanced air permeability. Air permeability defines how well air moves through the fabric. When used in connection with clothing, it is often described as "breathability." The air permeability of a fabric is also closely related to the drying time of a fabric. In some embodiments, enhanced air permeability may assist both in the drying of the moisture that is wicked to the outer face of the fabric (thereby maintaining and enhancing the moisture-wicking function of the fabric) and in maintaining and enhancing the cooling effect of the yarn comprising jade-containing fibers. As such, the enhanced air permeability of a fabric works in conjunction with the moisture wicking property and cooling property to provide the fabric with significant benefits when used in clothing that is configured to keep a wearer cool in hot temperatures or working conditions, while still providing a desired degree of protection.

The fabric may be configured to provide for enhanced air permeability during the weaving process, such as through the control of the density of the warp, e.g. the number of warp ends per inch in the loom. In some embodiments, such as where the yarn comprising jade-containing fibers is used in a denim fabric, the density of the warp may be controlled to provide an enhanced air permeability while at the same time maintaining the performance and appearance of conventional denim. For example, the denim fabric on the loom may comprise between about 45 and about 120 warp ends per inch, alternatively between about 45 and about 100 warp ends per inch, alternatively between about 50 and about 80 warp ends per inch, alternatively between about 55 and about 75 warp ends per inch.

Embodiments of the fabrics produced in accordance with the present invention may be characterized by a number of properties. One such property is the permeability index, or $i_m$ value. The permeability index represents the effect of skin moisture on heat loss, as in the case of a sweating skin condition. The permeability index measures moisture-heat permeability through a fabric on a scale of 0, which indicates that the fabric is completely impermeable, to 1, which indicates that the fabric is completely permeable.

The permeability index may be determined using a standard test method, as specified in ASTM F1868 part C, using a sweating hot plate. This test may be generally referred to as a sweating hot plate test. A sweating hot plate test provides an assessment of heat and moisture (vapor) transport through the fabric into a controlled environment. As such, the sweating hot plate test relates to the thermal resistance (insulation) of a fabric, the evaporative resistance (breathability/permeability) of a fabric, and the total heat loss from the plate through the fabric into the environment.

In some embodiments, the permeability index of the fabric may be at least 0.57, alternatively at least 0.58, alternatively at least 0.59, alternatively at least 0.60, alternatively at least 0.61, alternatively at least 0.62, alternatively at least 0.63, alternatively at least 0.64, alternatively at least 0.65, alternatively at least 0.66, alternatively at least 0.67, alternatively at least 0.68, alternatively at least 0.69, alternatively at least 0.70.

EXAMPLES

For the following examples, each denim fabric (3 by 1 twill) sample was prepared in the same manner using a 100% conventional cotton warp yarn, but with each sample comprising a different fill yarn. The first sample was a control fabric, which included a 100% conventional cotton fill yarn. The control fabric was selected to represent a conventional denim fabric of the type that is used in commercially available jeans. The fill yarn in the second sample was a hydrophobic cotton yarn sold under the commercial name TransDry®. The fill yarn in the third sample was a yarn made from a jade-containing polyester fiber. The fill yarn of the fourth sample was made from a blend of a conventional polyester fiber, the hydrophobic TransDry® cotton fiber of the type used in the second sample, and the jade-containing polyester fiber of the type used in the third sample. The samples were configured so that by averaging together the effects of the second and third samples, the expected impact of the fourth sample, i.e. the blended yarn, could be determined.

In order to provide for consistent results, the average weights and thicknesses of the samples were kept substantially similar. The weights of the samples were measured according to ASTM D 3776 small swatch option, by which 20 inch by 20 inch swatches of fabric were weighed and the weight calculated in terms of mass per unit area, specifically ounces per square yard. The weight of each sample was measured to be between about 13.0 and about 13.7 oz/yd$^2$. The thicknesses of the samples were measured according to ASTM D 1777 test option 1, by which 20 inch by 20 inch swatches of fabric were measured with a thickness gauge at an applied pressure of 0.6 psi at various locations of the fabric. The thickness of each sample was measured to be between 0.98 and 1.04 mm.

The results are shown in Table 1, below:

TABLE 1

| | Sweating Hot Plate - Skin Tests | | Moisture Vapor Transmission Rates | GATS | | Vertical |
|---|---|---|---|---|---|---|
| Category | Permeability Index $i_m$ | Total Heat Loss (QT) | MVTR Avg (g/24 hrs) | Absorption Capacity (g) | Drying Time (min) | Wicking 10 min. avg. (cm) |
| 100% COTTON CONTROL | 0.540 | 579 | 687 | 3.41 | 194 | 0.3 |
| Hydrophobic Cotton | 0.506 | 503 | 834 | 1.56 | 134 | 0.6 |
| Jade Polyester | −6% | −13% | 22% | −54% | −31% | 132% |
| | 0.573 | 605 | 677 | 3.18 | 208 | 1.6 |
| | 6% | 4% | −1% | −7% | 7% | 528% |
| BLEND: Jade Polyester + Hydrophobic Cotton + Polyester | 0.625 | 585 | 842 | 1.57 | 88 | 1.4 |

TABLE 1-continued

| Category | Sweating Hot Plate - Skin Tests | | Moisture Vapor Transmission Rates | GATS | | Vertical |
|---|---|---|---|---|---|---|
| | Permeability Index $i_m$ | Total Heat Loss (QT) | MVTR Avg (g/24 hrs) | Absorption Capacity (g) | Drying Time (min) | Wicking 10 min. avg. (cm) |
| Expected Impact | 0% | −4% | 10% | −30% | −12% | 330% |
| Actual Impact | 16% | 1% | 23% | −54% | −55% | 468% |

Example 1

The sweating hot plate test was performed on a number of fabric samples in accordance with ASTM F1868, part C. Heat and moisture transfer properties were analyzed using a guarded sweating hotplate system housed in an environmental test chamber set to achieve the required ambient conditions. The heat flow from the calibrated test plate (heated to a skin surface temperature of 35° C.) through a sample and into the test environment (25° C., 65% RH) was determined for both simulated dry and wet skin conditions.

As shown in Table 1, the permeability index of the control sample was found to be about 0.540. The permeability index of the second, i.e. hydrophobic cotton, sample was found to be about 0.506, which corresponded to an about 6% decrease compared to the control. The permeability index of the third, i.e. jade-containing polyester, sample was found to be about 0.573, which corresponded to an about 6% increase compared to the control. By averaging together the effects of the second and third samples, the expected impact of the fourth sample, i.e. the blended yarn, was determined to be a 0% impact on the control. In other words, the blended yarn was expected to have a permeability index that was about the same as the control sample. However, the permeability index of the sample comprising the blended yarn was found to be about 0.625, which represented a 16% increase over the control sample.

Based on these results, it is believed that a fabric comprising a combination of jade-containing fibers and hydrophobic cotton fibers in the fill yarn may have an unexpectedly high permeability index.

Another property that may be used to characterize the fabric of embodiments of the invention is the "Total Heat Loss," designated as $Q_t$, which is may also be determined by a standard test method, as specified in ASTM F1868 part C, using a sweating hot plate. The Total Heat Loss is an indicator of the heat transferred through the fabric, by the combined dry and evaporative heat loss, from a fully sweating test plate surface into the test environment. Accordingly an increase in heat loss in the samples over the control demonstrates an increased cooling effect of the fabric.

Although the expected impact of the blended yarn was a 4% decrease in heat loss, the blended fiber was found to provide a 1% increase in cooling effect over the control. Based on these results, it is believed that a fabric comprising a combination of jade-containing fibers and hydrophobic cotton fibers in the fill yarn may produce a significant impact on total heat loss of the fabric, i.e. a fabric having a significant cooling effect.

Example 2

Moisture Vapor Transmission Results or MVTR, measures the rate of moisture vapor diffusion through a fabric. The rate of moisture vapor diffusion through the fabric is determined according to a Simple Dish Method, similar to ASTM E96-80. A sample is placed on a water dish (82 mm in diameter and 19 mm in depth) allowing a 9 mm air space between the water surface and specimen. A vibration free turntable carrying 8 dishes rotates uniformly at 5 meters per minute to ensure that all dishes are exposed to the same average ambient conditions during the test. The assembled specimen dishes are allowed to stabilize for two hours before taking the initial weight. They are weighed again after a 24 hours interval. Then the rate of moisture vapor loss (MVTR) is calculated in units of g/cm$^2$-24 hours. A higher MVTR value indicates there is a greater passage of moisture vapor through the material. Accordingly, an increase in MVTR is a positive for cooling.

The expectation of the fabric sample comprising the blended yarn, as determined by averaging together the effects of the second and third samples, was a 10% improvement in MVTR. The fabric sample comprising the blended yarn actually resulted in a 23% improvement in MVTR compared to the same control. Based on these results, it is believed that a combination of jade-containing fibers and hydrophobic cotton fibers in the fill yarn may provide a fabric with a significant improvement in moisture vapor diffusion.

Example 3

The Gravimetric Absorbency Testing System (GATS) is used to measure both the absorption capacity of the test fabrics and the drying time of the test fabrics.

Absorption capacity is measured by the amount of water drawn from a water filled reservoir. During testing, water absorbed by the test specimen is re-supplied through a tube that connects to the porous test plate. Absorption Capacity measures the amount of moisture a fabric can retain before it becomes completely saturated. It is measured by subtracting the dry weight of the sample from the wet weight of the sample at the end of the GATS test. A decrease in absorption capacity is generally a positive for cooling.

The expectation of the fabric sample comprising the blended yarn, as determined by averaging together the effects of the second and third samples, was a 30% reduction in absorption capacity. The fabric sample comprising the blended yarn actually resulted in a 54% reduction in absorption capacity compared to the same control. Based on these results, it is believed that a combination of jade-containing fibers and hydrophobic cotton fibers in the fill yarn may provide a fabric with a significant improvement in absorption capacity.

Drying Time measures the amount of time required for a fabric to dry from the point of complete saturation. After the dry weight of the sample specimen is recorded, the absorption capacity value obtained as described above is used as the initial amount of water to be added to the dry test specimen. After saturating the fabric, the wet weight is determined, a constant airflow over the test plate is created, and timing is started. Weight is recorded after 10 minute intervals. When weight is constant for successive readings (Δweight<=0.005 g) or when the fabric returns to its original weight (tare weight=0), the final weight is recorded. The time needed for the fabric to dry from saturation is reported in minutes.

A decrease in drying time is a positive for cooling. The general expectation of the fabric sample comprising the blended yarn, as determined by averaging together the effects of the second and third samples, was a 12% reduction in drying time. The fabric sample comprising the blended yarn actually resulted in a 54% reduction compared to the same control. Based on these results, it is believed that a combination of jade-containing fibers and hydrophobic cotton fibers in the fill yarn may provide a fabric with a significant improvement in drying time.

Example 4

Vertical Wicking measures the ability of a fabric to wick moisture. An increase in vertical wicking is a positive for cooling.

The water transport rate of a fabric is measured according to a vertical strip wicking test. One end of a strip (25 mm wide×170 mm long) of the fabric sample was clamped vertically with the free end immersed to about 3 mm in distilled water at 21° C. The height to which the water was transported along the strip is measured at 1, 5 and 10 minute intervals and reported in centimeters (cm). Fabrics were tested in both the length (warp) and cross (fill) directions.

The general expectation of the fabric sample comprising the blended yarn, as determined by averaging together the effects of the second and third samples, was a 330% increase in vertical wicking. The fabric sample comprising the blended yarn actually resulted in a 468% improvement compared to the same control. Based on these results, it is believed that a combination of jade-containing fibers and hydrophobic cotton fibers in the fill yarn may provide a fabric with a significant wicking effect.

Although certain weights and thicknesses of denim fabrics were used in the Examples provided above, a fabric having any desired weight and/or thickness may be prepared without departing from the scope of the present invention. For instance, in some embodiments, such as in some embodiments where the denim fabric is configured for the manufacture of jeans, the weight of the fabric may range between about 8 oz/yd$^2$ and about 15 oz/yd$^2$, such as for example between about 8 oz/yd$^2$ and about 12 oz/yd$^2$ for more lightweight fabrics or between about 12 oz/yd$^2$ and about 15 oz/yd$^2$ for more heavyweight fabrics. Similarly, in some embodiments, such as in some embodiments where the denim fabric is configured for the manufacture of jeans, the thickness of the fabric may range between about 0.60 mm and about 1.20 mm, such as for example between about 0.60 mm and 0.80 mm for thinner fabrics or between about 1.00 mm and about 1.20 mm for thicker fabrics.

In some embodiments, the denim fabric may be configured to provide a "blue jean" material that is useful for the manufacture of jeans (jean pants), jean jackets, and the like. The denim fabric may be configured to provide a "blue jean" material by a conventional manner, such as those that would be understood by a person of ordinary skill in the art. In some embodiments, the yarn used in the warp of the fabric may be dyed with, for example, an indigo dye. In these embodiments, the fill may be left undyed and uncolored. Alternatively, the front surface of the denim fabric may be dyed with, for example, an indigo dye. And in some embodiments, both dyeing processes may be performed.

The fabric comprising a yarn having jade-containing fibers may be used to produce any number of products, including bed sheets, towels, upholstery for furniture such as outdoor furniture, and the like. The fabric is particularly useful for the manufacture of clothing. For example, the fabric may be used in the manufacture of pants, shorts, shirts, jackets, undergarments, socks, hats, sweatbands, bandanas, and the like. In some embodiments, the fabric is a denim fabric, such as may be particularly useful in the manufacture of pants, e.g. blue jeans. As described herein, the products and clothing produced using the fabric described above may benefit from enhanced cooling effects, moisture-wicking, and permeability.

It can be seen that the described embodiments provide unique and novel fibers, yarns, fabrics, and clothing that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A yarn comprising a blend of:
conventional fibers;
hydrophobic cotton fibers; and
jade-containing polyester fibers,
wherein the yarn exhibits a moisture vapor transmission result greater than a moisture vapor transmission result of a second yarn in the absence of the jade-containing polyester fibers when tested in accordance with ASTM E96-80.

2. The yarn of claim 1, in which the blend comprises
between about 20% and about 40% of conventional fibers;
between about 20% and about 40% of hydrophobic cotton fibers;
between about 20% and about 40% of jade-containing polyester fibers.

3. The yarn of claim 2, in which the blend comprises
about 33% conventional fibers;
about 33% hydrophobic cotton fibers;
about 33% jade-containing polyester fibers.

4. The yarn of claim 1, in which the yarn comprises a blend of staple fibers.

5. The yarn of claim 1, in which the conventional fibers comprise cotton, polyester, or a mixture thereof.

6. The yarn of claim 1, in which the jade-containing polyester fibers comprise between about 0.3 wt. % and about 1.5 wt. % jade.

7. The yarn of claim 1, in which the jade is substantially evenly distributed throughout the jade-containing polyester fibers.

8. The yarn of claim 1, in which the conventional fibers comprise high-tenacity polyester.

9. The yarn of claim 1, in which the hydrophobic cotton fibers comprise a water-repelling fluorochemical.

10. A moisture-wicking and cooling fabric comprising
a warp, and
a fill,
wherein the fill comprises the yarn of claim 1.

11. The fabric of claim 10, in which the warp comprises a conventional cotton yarn.

12. The fabric of claim 11, in which greater than 50% of the warp is exposed on the front surface of the fabric, and greater than 50% of the fill is exposed on the back surface of the fabric.

13. The fabric of claim 11, in which greater than 70% of the warp is exposed on the front surface of the fabric, and greater than 70% of the fill is exposed on the back surface of the fabric.

14. The fabric of claim 11, in which the fabric comprises a denim twill weave.

15. The fabric of claim 11, in which at least the warp yarn comprises an indigo dye.

16. The fabric of claim 11, in which the fabric has a permeability index of at least 0.60.

17. The fabric of claim 11, in which the fill consists entirely of the yarn of claim 1.

18. The fabric of claim 11, in which the warp consists entirely of conventional cotton yarn.

19. A pant comprising the fabric of claim 11.

20. A shirt comprising the fabric of claim 11.

21. The yarn of claim 1, in which the jade-containing polyester fibers comprise jade powder.

22. The yarn of claim 21, in which the jade-containing polyester fibers are prepared by:

mixing a jade powder into a polyester melt;

extruding the jade-containing polyester melt to produce a filament;

cutting the filament to produce jade-containing polyester staple fibers.

* * * * *